US012702900B1

(12) United States Patent
Scott

(10) Patent No.: US 12,702,900 B1
(45) Date of Patent: Aug. 11, 2026

(54) REDUCED HOSEL EXIT BORE SIZE FOR IFIT SYSTEM FOR GOLF CLUBS

(71) Applicant: Topgolf Callaway Brands Corp., Carlsbad, CA (US)

(72) Inventor: Timothy G. Scott, Encinitas, CA (US)

(73) Assignee: Callaway Golf Company, Carlsbad, CA (US)

( * ) Notice: Subject to any disclaimer, the term of this patent is extended or adjusted under 35 U.S.C. 154(b) by 665 days.

(21) Appl. No.: 18/135,521

(22) Filed: Apr. 17, 2023

Related U.S. Application Data

(60) Provisional application No. 63/341,325, filed on May 12, 2022.

(51) Int. Cl.
*A63B 53/02* (2015.01)
*A63B 53/04* (2015.01)

(52) U.S. Cl.
CPC ..... *A63B 53/02* (2013.01); *A63B 53/0412* (2020.08); *A63B 53/0433* (2020.08); *A63B 53/0466* (2013.01)

(58) Field of Classification Search
CPC ..... A63B 53/02
See application file for complete search history.

(56) References Cited

U.S. PATENT DOCUMENTS 5,513,844 A * 5/1996 Ashcraft ..... A63B 53/0466 473/307
7,326,126 B2 * 2/2008 Holt ..... A63B 60/00 473/307
8,025,587 B2 * 9/2011 Beach ..... A63B 53/08 473/307
8,715,102 B1 * 5/2014 Aguinaldo ..... A63B 53/06 473/246
8,715,104 B1 * 5/2014 Wall, Jr. ..... A63B 60/00 473/309
8,801,537 B1 * 8/2014 Seluga ..... A63B 59/60 473/307
9,101,806 B1 * 8/2015 Aguinaldo ..... A63B 53/02
9,119,998 B1 * 9/2015 Wall, Jr. ..... A63B 60/00
9,168,427 B1 * 10/2015 Aguinaldo ..... A63B 60/42
9,283,446 B2 * 3/2016 Motokawa ..... A63B 53/02
9,586,101 B2 * 3/2017 Motokawa ..... A63B 53/0466
9,623,302 B1 * 4/2017 Myers ..... A63B 53/0466
9,636,551 B1 * 5/2017 Aguinaldo ..... A63B 71/06
9,636,553 B1 * 5/2017 Myers ..... A63B 60/52
9,724,571 B2 * 8/2017 Burch ..... A63B 53/02
10,076,691 B1 * 9/2018 Kingston ..... A63B 53/04
10,369,437 B1 * 8/2019 Cleghorn ..... A63B 53/0466
10,596,421 B1 * 3/2020 Myers ..... A63B 60/50
11,033,782 B1 * 6/2021 Evans ..... A63B 53/04
11,207,577 B1 * 12/2021 Evans ..... A63B 53/04
11,278,770 B1 * 3/2022 Tuber ..... A63B 53/005
2008/0119301 A1 * 5/2008 Holt ..... A63B 53/00 473/307

(Continued)

*Primary Examiner* — Nicholas J. Weiss
*Assistant Examiner* — Kalyn Gabrielle Younger
(74) *Attorney, Agent, or Firm* — Michael A. Catania; Daniel Moderick

(57) ABSTRACT

A golf club having a removable shaft is disclosed herein. A sole wall of a golf club head of the golf club has a hosel exit bore having an upper section and a lower section. The upper section is configured for transverse placement of a washer in the hosel exit bore. A screw threadingly engages the threaded bore through the washer and hosel exit bore.

4 Claims, 17 Drawing Sheets

(56) References Cited

U.S. PATENT DOCUMENTS

| | | | | |
|---|---|---|---|---|
| 2012/0231896 | A1* | 9/2012 | Seluga | A63B 53/02 473/314 |
| 2013/0085010 | A1* | 4/2013 | Beach | A63B 53/02 473/307 |
| 2014/0121035 | A1* | 5/2014 | Nivanh | A63B 53/0466 473/309 |
| 2014/0135143 | A1* | 5/2014 | Aguinaldo | A63B 53/0466 473/307 |
| 2014/0221119 | A1* | 8/2014 | Aguinaldo | A63B 53/02 473/307 |
| 2015/0005093 | A1* | 1/2015 | Motokawa | A63B 53/02 473/307 |
| 2015/0005097 | A1* | 1/2015 | Motokawa | A63B 60/00 473/338 |
| 2016/0016051 | A1* | 1/2016 | Dacey | A63B 53/06 473/305 |
| 2016/0184662 | A1* | 6/2016 | Barelmann | A63B 53/02 473/307 |
| 2018/0200590 | A1* | 7/2018 | Evans | A63B 53/06 |

* cited by examiner

REDUCED HOSEL EXIT BORE SIZE FOR IFIT SYSTEM FOR GOLF CLUBS

CROSS REFERENCES TO RELATED APPLICATIONS

The Present Application claims priority to U.S. Provisional Patent Application No. 63/341,325, filed on May 12, 2022, which is hereby incorporated by reference in its entirety.

STATEMENT REGARDING FEDERALLY SPONSORED RESEARCH OR DEVELOPMENT

Not Applicable

BACKGROUND OF THE INVENTION

Field of the Invention

The present invention relates to a golf club with a hosel exit bore.

Description of the Related Art

Various golf club manufacturers offer golf club heads with adjustable hosels. Most of these club heads include a hosel exit bore in the sole wall, in communication with a hosel through-opening extending from the top of the hosel to the crown, through which a screw is inserted to engage the shaft sleeve. While this structure allows a user to reversibly attach the shaft sleeve, and thereby the shaft, to the club head, the hosel exit bore is sized for ease of access to a screw that secures a shaft to a golf club head, and thus reduces the area of the sole wall.

BRIEF SUMMARY OF THE INVENTION

The present invention relates to a golf club, and particularly club such as drivers, fairway-woods, and hybrids, comprising a reduced size hosel exit bore.

One aspect of the present invention is a golf club having a removable shaft. The golf club comprises a shaft, a hosel assembly and a golf club head. The shaft has a butt end and a tip end. The hosel assembly is connected to the tip end of the shaft. The hosel assembly comprises a screw, at least one washer and a shaft sleeve having a threaded bore. The golf club head has a sole wall. The sole wall has a hosel exit bore having an upper section and a lower section. The upper section has a width greater than the lower section. The upper section is configured for transverse placement of a washer in the hosel exit bore. The screw threadingly engages the threaded bore through the at least one washer and the hosel exit bore.

Another aspect of the present invention is a golf club having a removable shaft. The golf club comprises a shaft, a hosel assembly and a golf club head. The shaft a butt end and a tip end. The hosel assembly is connected to the tip end of the shaft. The hosel assembly comprises a screw, at least one washer and a shaft sleeve having a threaded bore. The golf club head has a sole wall. The sole wall has a first internal wall, a second internal wall and a third internal wall. The first internal wall, the second internal wall and the third internal wall define a hosel exit bore. The hosel exit bore has an upper region and a lower region. The upper region has a width greater than the lower region. The upper region is configured for placement of the at least one washer. The screw threadingly engages the threaded bore through the at least one washer and the hosel exit bore.

Yet another aspect of the present invention is a golf club head comprising a striking plate, a crown wall and a sole wall. The sole wall has a hosel exit bore. The hosel exit bore has an upper section and a lower section. The upper section has a width greater than the lower section.

Yet another aspect of the present invention a golf club head comprising a striking plate, a crown wall and a sole wall. The sole wall has a first internal wall, a second internal wall and a third internal wall. The first internal wall, the second internal wall and the third internal wall define a hosel exit bore. The hosel exit bore has an upper region and a lower region. The upper region has a width greater than the lower region. The upper region is configured for transverse placement of a washer in the hosel exit bore.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
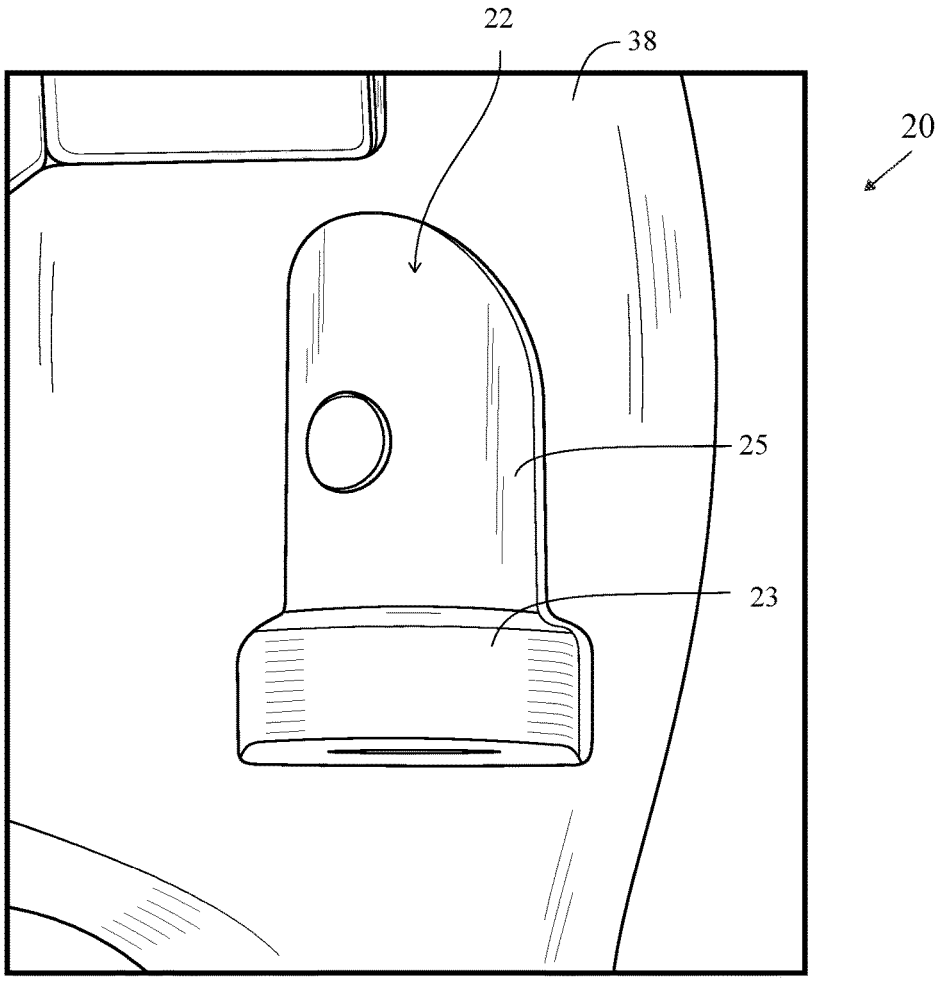
FIG. 1 is an isolated view of a hosel exit bore of the present invention.

One embodiment is a golf club having a removable shaft. The golf club comprises a shaft, a hosel assembly and a golf club head. The shaft has a butt end and a tip end. The hosel assembly is connected to the tip end of the shaft. The hosel assembly comprises a screw, at least one washer and a shaft sleeve having a threaded bore. The golf club head has a sole wall. The sole wall has a hosel exit bore having an upper section and a lower section. The upper section has a width greater than the lower section. The upper section is configured for transverse placement of a washer in the hosel exit bore. The screw threadingly engages the threaded bore through the at least one washer and the hosel exit bore.

A width of the upper section preferably ranges from 0.49 inch to 0.55 inch, and a width of the lower section preferably ranges from 0.37 inch to 0.55 inch. A length of the upper section preferably ranges from 0.15 inch to 0.25 inch. A first section of the sole wall preferably defines the upper section of the hosel exit bore and has an inward angle. A second section of the sole wall preferably defines the lower section of the hosel exit bore and forms an undercut portion below the first section of the sole wall.

The golf club is preferably a driver, a fairway wood or a hybrid. In one embodiment, the golf club head is a driver head having a volume ranging from 400 to 470 cubic centimeters (cc). The shaft is preferably composed of a graphite material. The golf club head preferably comprises a titanium alloy material or an iron alloy material. Alternatively, the golf club head comprises a composite material. The golf club head preferably comprises a striking plate, a crown wall, and a hosel.

The golf club preferably further comprises a second washer. The hosel exit bore preferably defines a volume less than 0.12 cubic inch. The hosel exit bore preferably has a length ranging from 0.5 inch to 1.0 inch. The upper section of the hosel exit bore preferably has a depth ranging from 0.25 inch to 0.5 inch. The lower section of the hosel exit bore preferably has a depth ranging from 0.1 inch to 0.3 inch. A second section of the sole wall preferably defines the lower section of the hosel exit bore and has a radius of curvature ranging from 0.1 inch to 0.5 inch. A first section of the sole wall preferably defines the upper section of the hosel exit bore and has a radius of curvature ranging from 0.2 inch to 0.5 inch. A first section of the sole wall preferably defines the upper section of the hosel exit bore and has a radius of curvature larger than a radius of curvature of a second section of the sole wall defining the lower section of the hosel exit bore.

Another embodiment is a golf club having a removable shaft. The golf club comprises a shaft, a hosel assembly and a golf club head. The shaft a butt end and a tip end. The hosel assembly is connected to the tip end of the shaft. The hosel assembly comprises a screw, at least one washer and a shaft sleeve having a threaded bore. The golf club head has a sole wall. The sole wall has a first internal wall, a second internal wall and a third internal wall. The first internal wall, the second internal wall and the third internal wall define a hosel exit bore. The hosel exit bore has an upper region and a lower region. The upper region has a width greater than the lower region. The upper region is configured for placement of the at least one washer. The screw threadingly engages the threaded bore through the at least one washer and the hosel exit bore.

Another embodiment is a golf club head comprising a striking plate, a crown wall and a sole wall. The sole wall has a hosel exit bore. The hosel exit bore has an upper section and a lower section. The upper section has a width greater than the lower section.

Another embodiment is a golf club head comprising a striking plate, a crown wall and a sole wall. The sole wall has a first internal wall, a second internal wall and a third internal wall. The first internal wall, the second internal wall and the third internal wall define a hosel exit bore. The hosel exit bore has an upper region and a lower region. The upper region has a width greater than the lower region. The upper region is configured for transverse placement of a washer in the hosel exit bore.

Figure 15A:
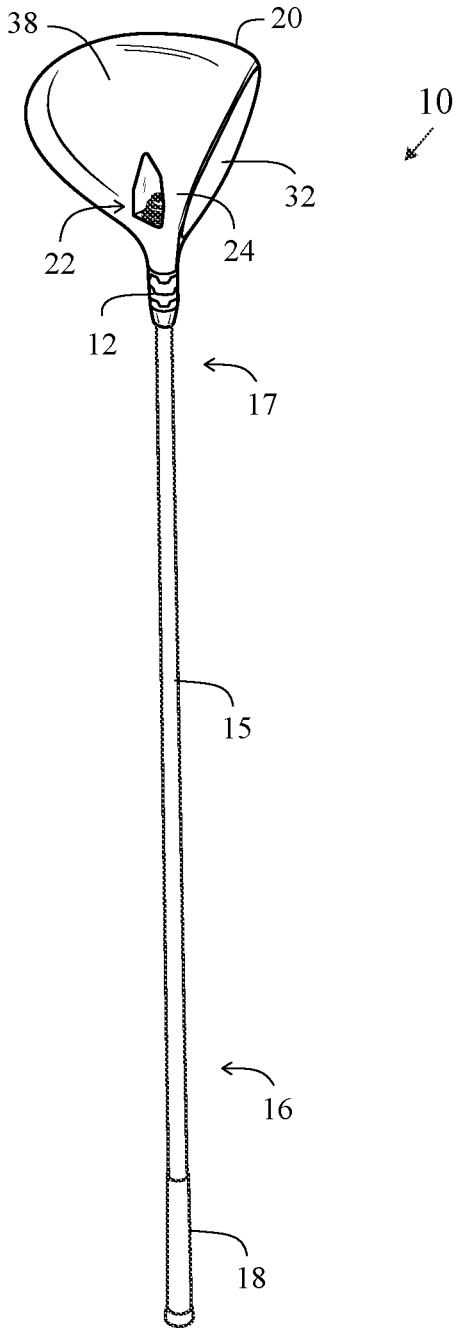
FIG. 15A is an illustration of a golf club of the present invention, heel side.
Figure 15B:
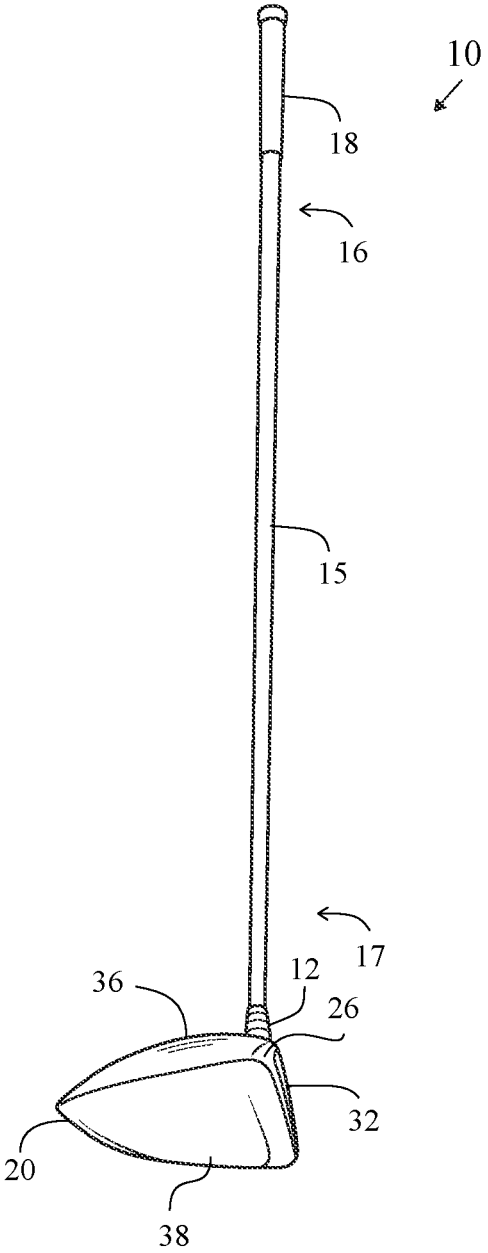
FIG. 15B is an illustration of a golf club of the present invention, toe side.
Figure 16:
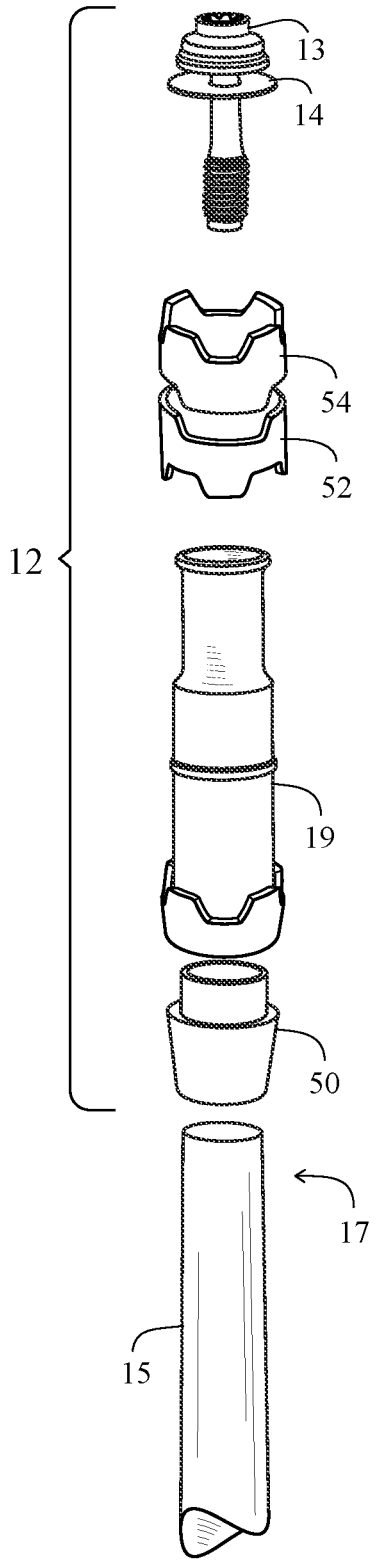
FIG. 16 is an exploded view of a hosel assembly of a golf club of the present invention.
Figure 17:
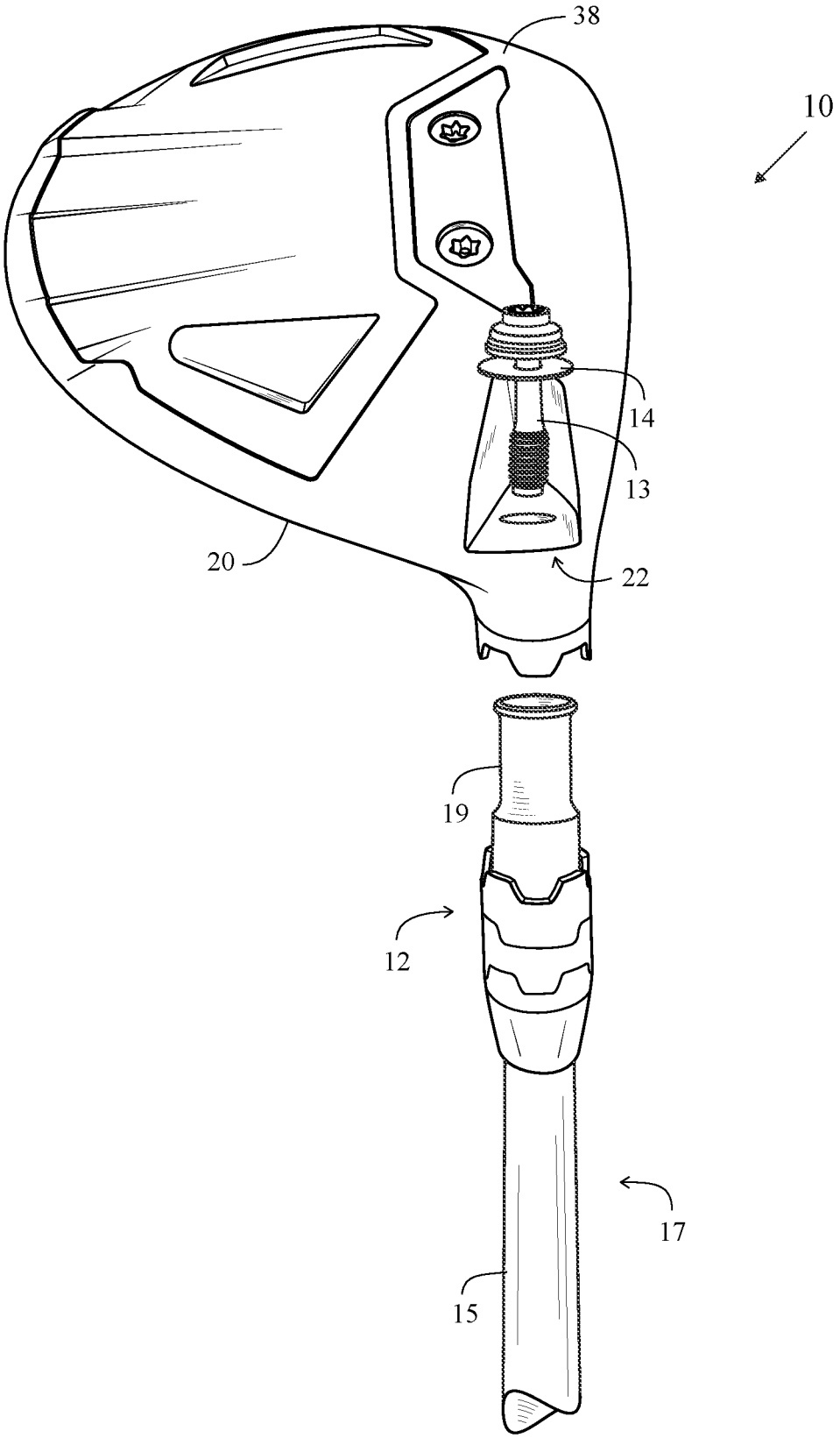
FIG. 17 is an exploded view of a golf club of the present invention.

A golf club 10, as shown in FIGS. 15A-15B and FIG. 17, having a removable shaft 15, comprises a shaft 15, a hosel assembly 12, and a club head 20. The shaft 15 has a butt end 16 and a tip end 17. The hosel assembly 12, as shown in FIG. 16, connected to the tip end 17 of the shaft, comprises a screw 13, at least one washer 14 and a shaft sleeve 19 having a threaded bore, as shown in FIG. 16.

Figure 1A:
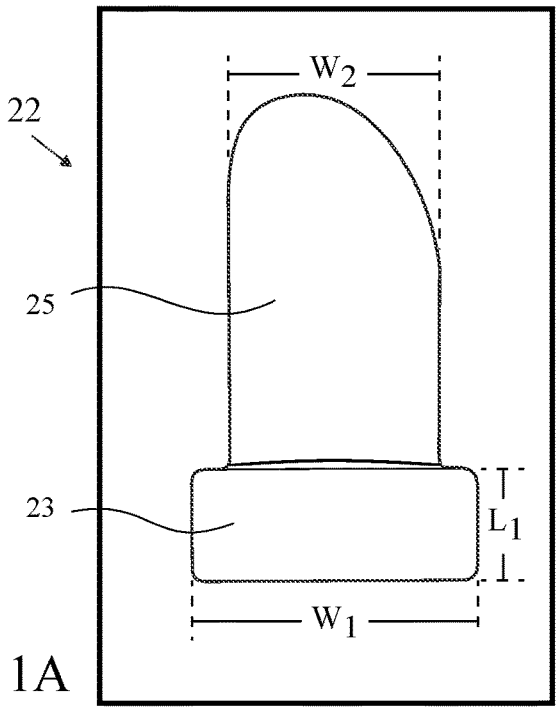
FIG. 1A is an isolated view of a hosel exit bore of the present invention.
Figure 2:
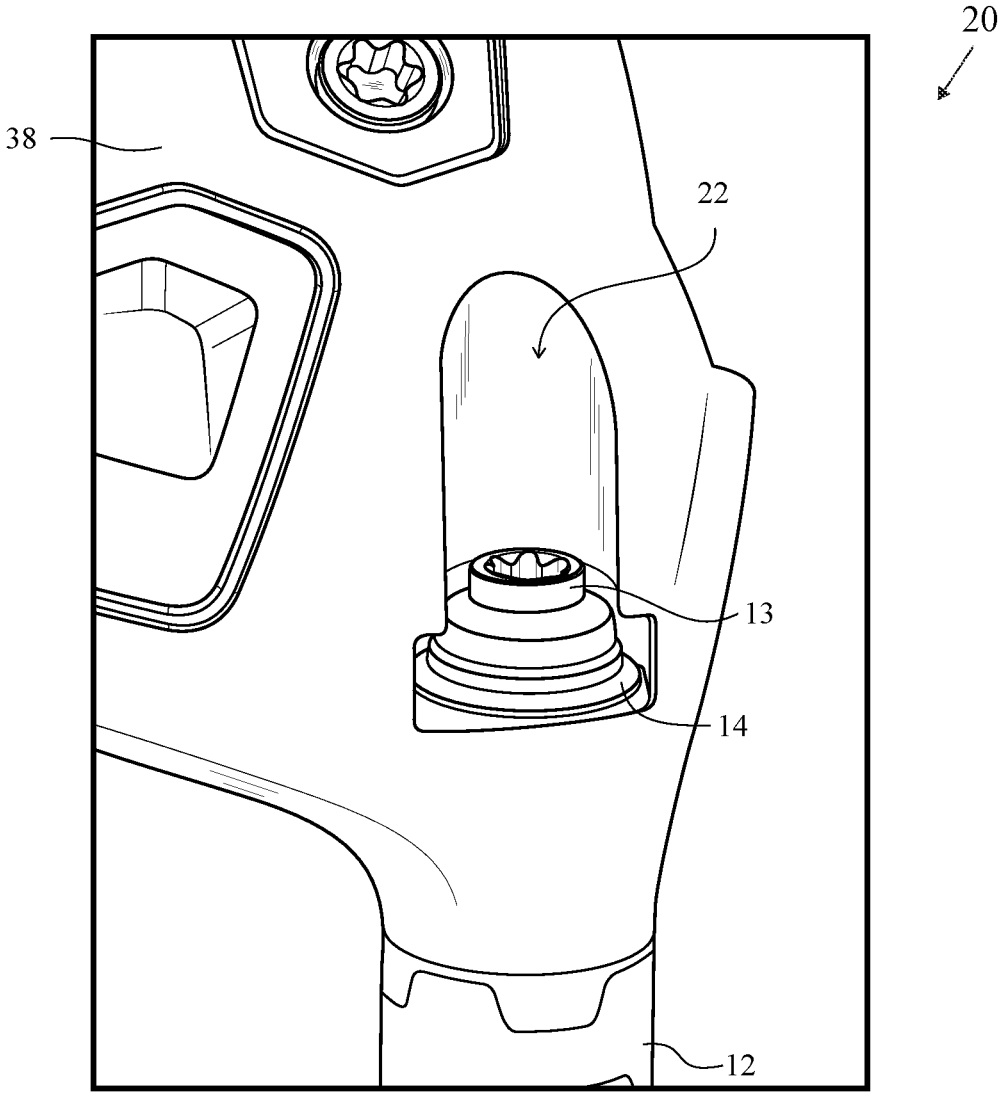
FIG. 2 is an isolated view of a hosel exit bore of the present invention.
Figure 3:
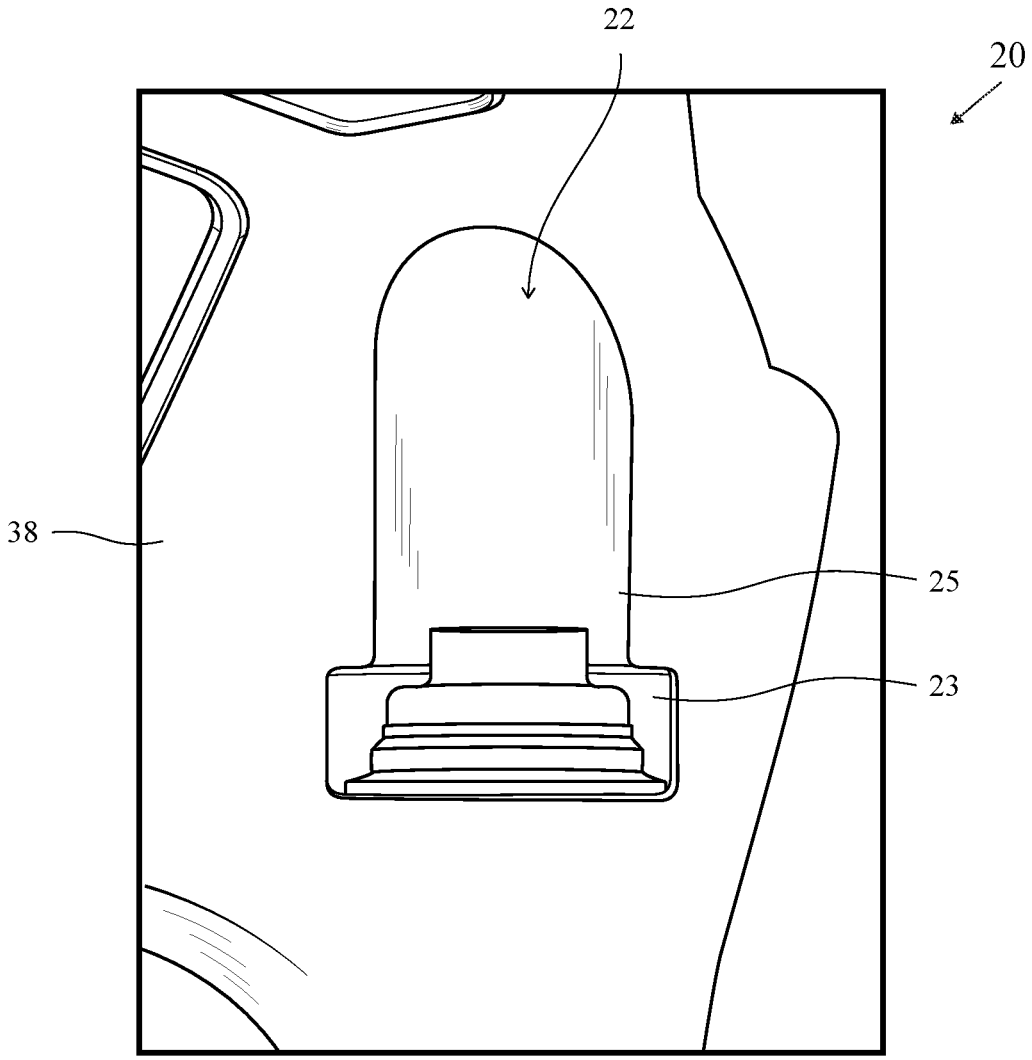
FIG. 3 is an isolated view of a hosel exit bore of the present invention.
Figure 4:
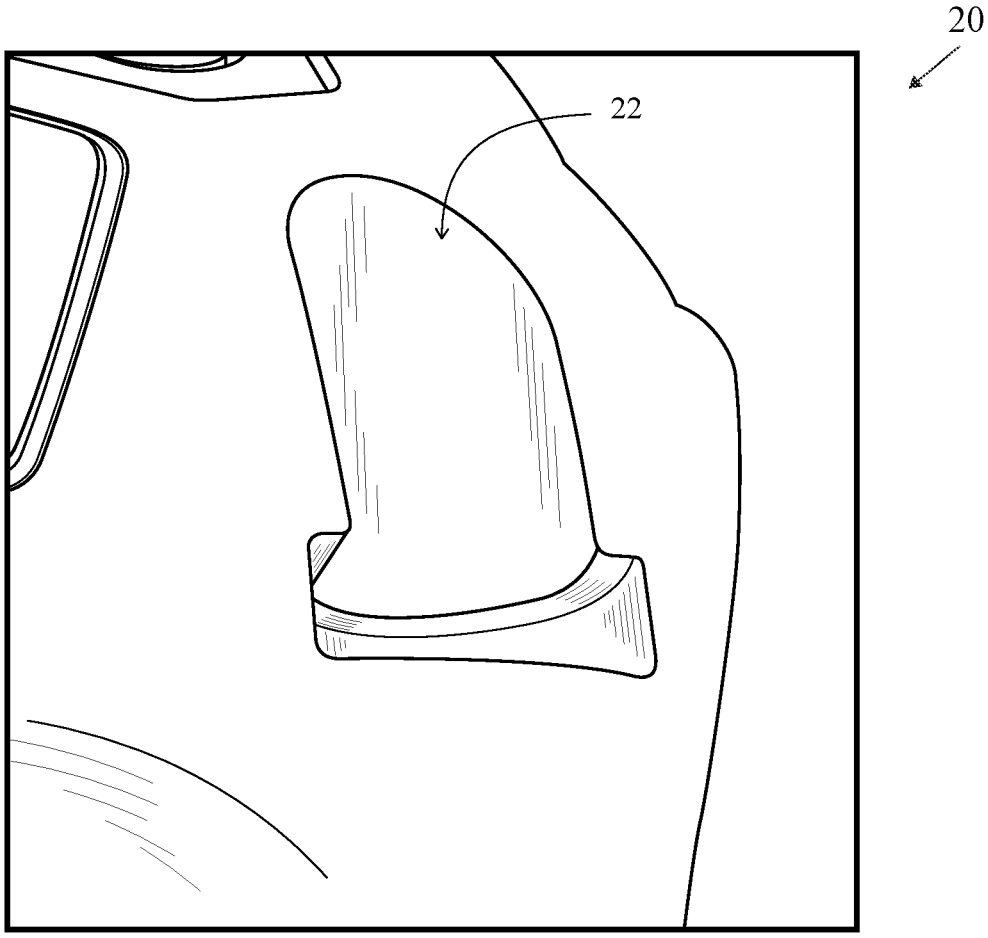
FIG. 4 is an isolated view of a hosel exit bore of the present invention.
Figure 5:
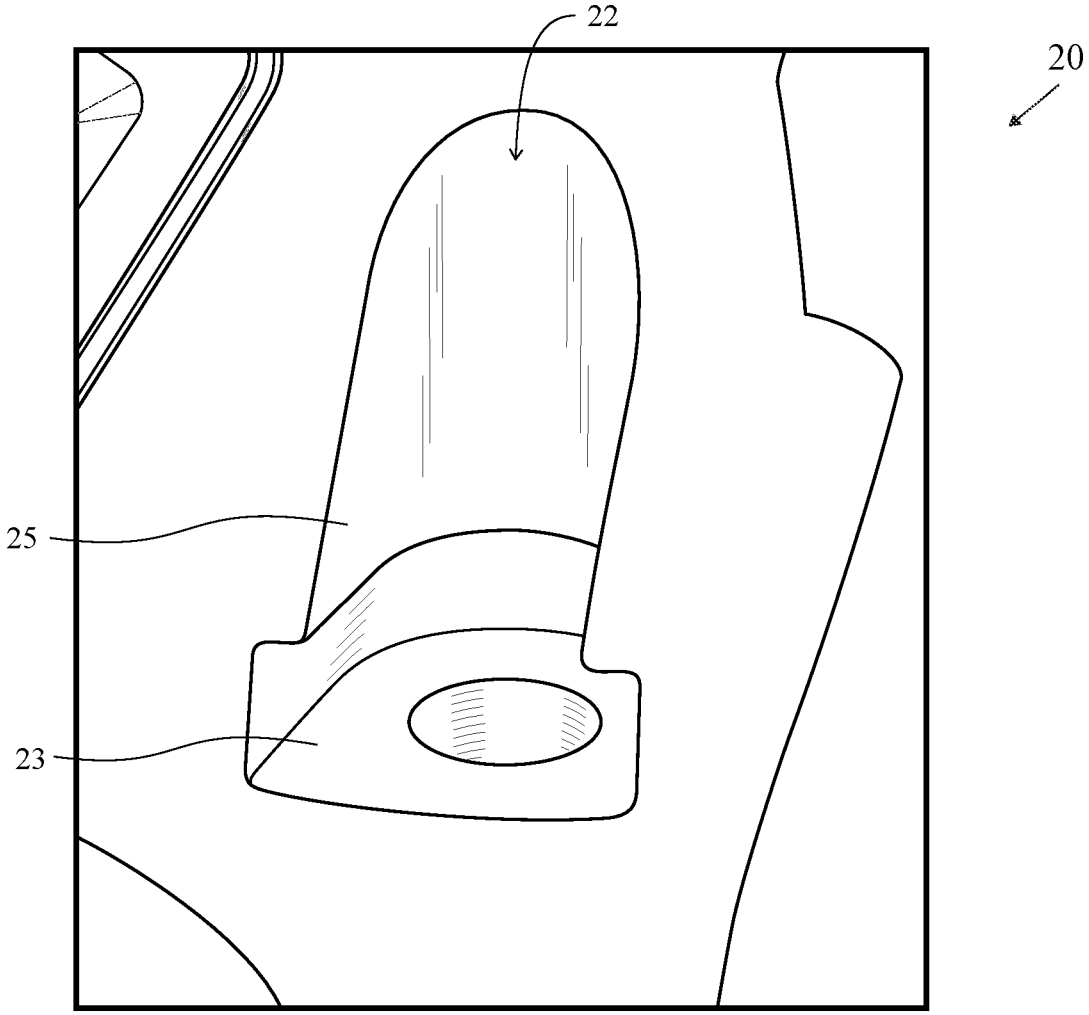
FIG. 5 is an isolated view of a hosel exit bore of the present invention.

The club head 20, as shown in FIGS. 1-5, has a sole wall 38 which has a hosel exit bore 22 comprising an upper section 23 and a lower section 25. Preferably, the upper section 23 is wider than than the lower section 25, as shown in FIG. 1A, with width W1 greater than width W2. Preferably, the upper section 23 has a width W1 from 0.49 inch to 0.55 inch and a length L1 from 0.15 inch to 0.25 inch, and the lower section 25 has a width W2 from 0.37 inch to 0.55 inch.

In another embodiment, the club head 20 has a sole wall 38 with three distinct internal walls. The three internal walls of the sole wall 38 define a hosel exit bore 22 comprising an upper section 23 and a lower section 25.

Figure 6:
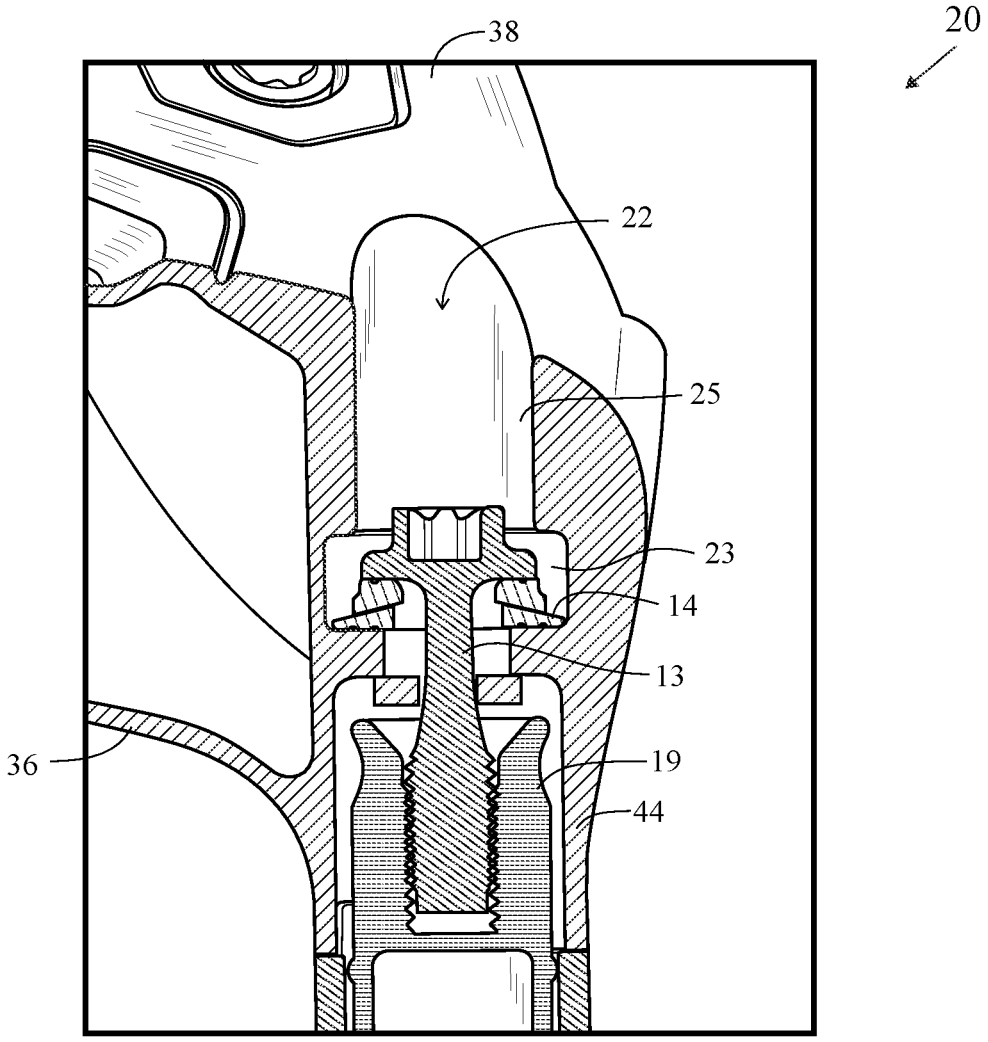
FIG. 6 is an isolated partial cross-sectional view of a hosel exit bore of the present invention.

The upper section 23 is configured for placement of the washer 14 and the screw 13 is inserted from the lower section and engages the threaded bore of the shaft sleeve 19 through at least one washer 14 and the hosel exit bore 22, as shown in FIG. 6. Preferably, there is a second washer.

Figure 7:
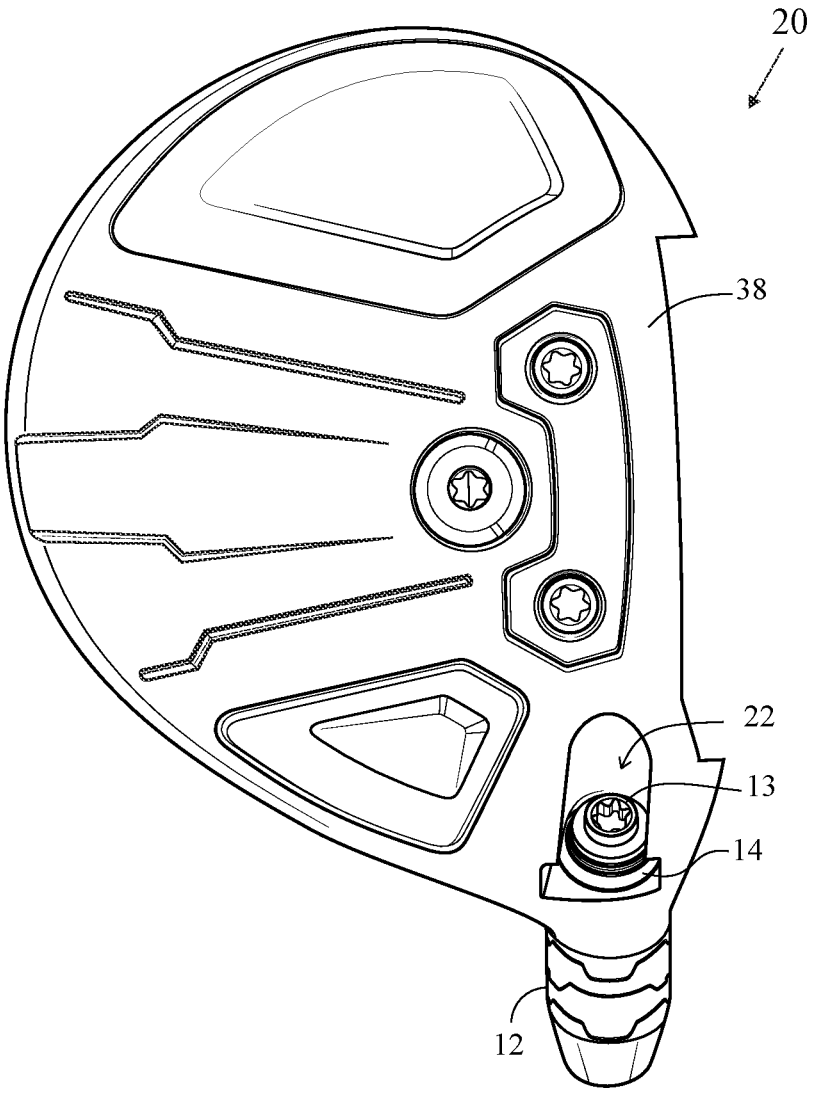
FIG. 7 is a bottom perspective view of a golf club.

FIG. 7 is a bottom view of a club head 20 with the hosel assembly 12 in place. The sole wall 38 comprises a hosel exit bore 22, which extends into the heel side 24. Preferably, a first section of the sole wall 38 defining the upper section 23 of the hosel exit bore 22 has a radius of curvature ranging from 0.2 inch to 0.5 inch. The radius of curvature of the first section is larger than a radius of curvature of a second section of the sole wall 38 defining the lower section 25 of the hosel exit bore 22.

In another embodiment, the second internal wall of the sole wall 38 has an inward angle. The second internal wall is at an obtuse angle relative to the first internal wall and the second internal wall is at an acute angle to the third internal wall. The third internal wall has a depth greater than a depth of the first internal wall.

Preferably, a second section of the sole wall 38 defining the lower section 25 of the hosel exit bore 22 forms an undercut portion below the first section of the sole wall 38. A second section of the sole wall 38 defining the lower section 25 of the hosel exit bore 22 has a radius of curvature ranging from 0.1 inch to 0.5 inch.

Preferably, the golf club 10 is a driver, a fairway wood or a hybrid.

Preferably, the golf club head is a driver head having a volume ranging from 400 to 470 cubic centimeters (cc). The golf club head comprises a titanium alloy material. Alternatively, the golf club head comprises an iron alloy material or a composite material. The golf club head comprises a striking plate 32, a crown wall 36, and a hosel 12.

The shaft is preferably composed of a graphite material.

Figure 8:
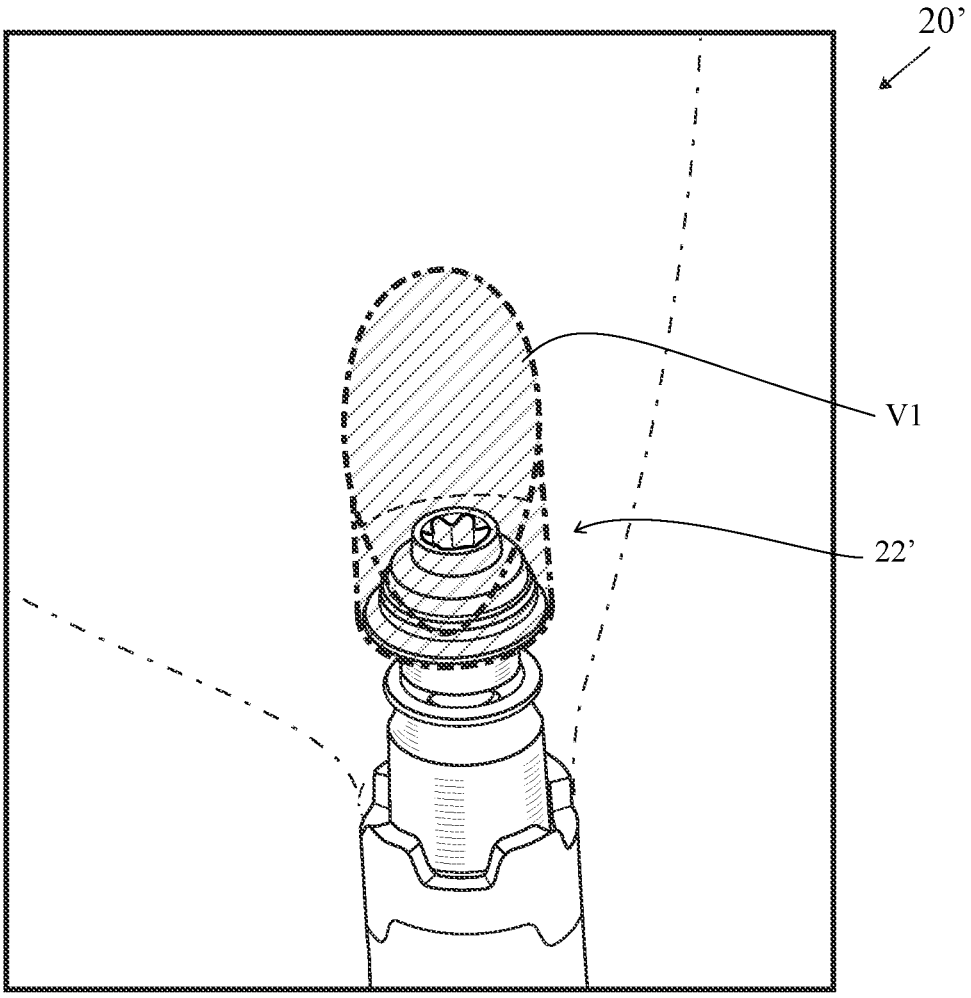
FIG. 8 (PRIOR ART)
FIG. 8 is an illustration of the volume of a hosel exit bore of a prior art golf club.
Figure 9:
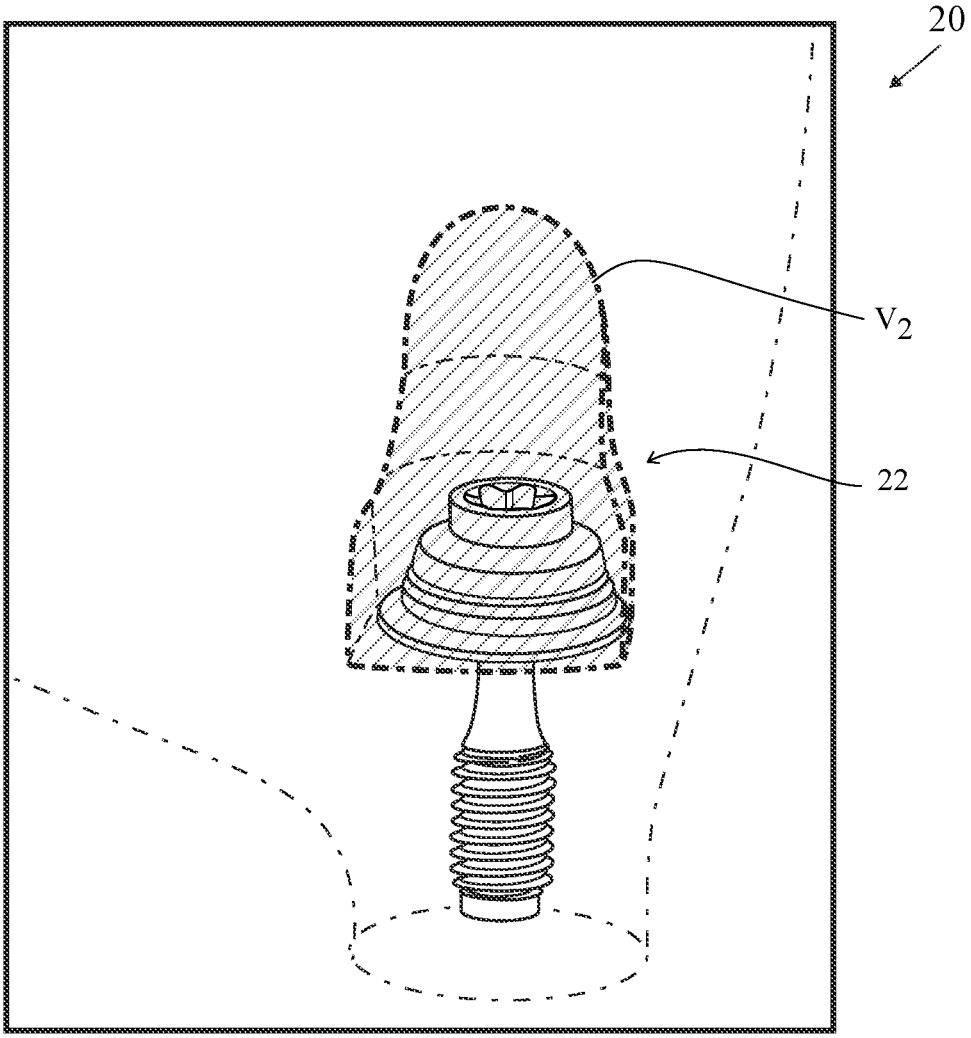
FIG. 9 is an illustration of the volume of a hosel exit bore of the present invention.
Figure 10:
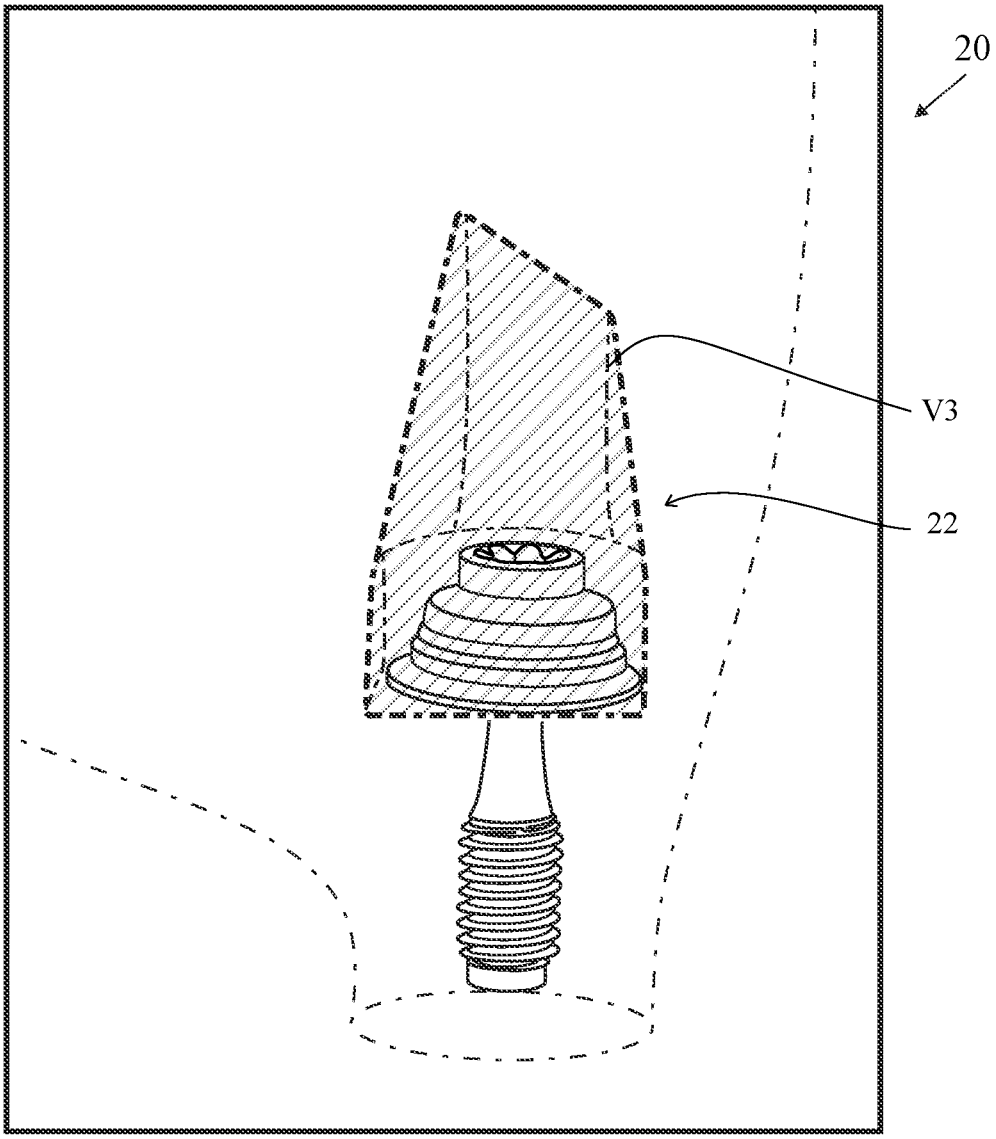
FIG. 10 is an illustration of the volume of a hosel exit bore of the present invention.
Figure 11:
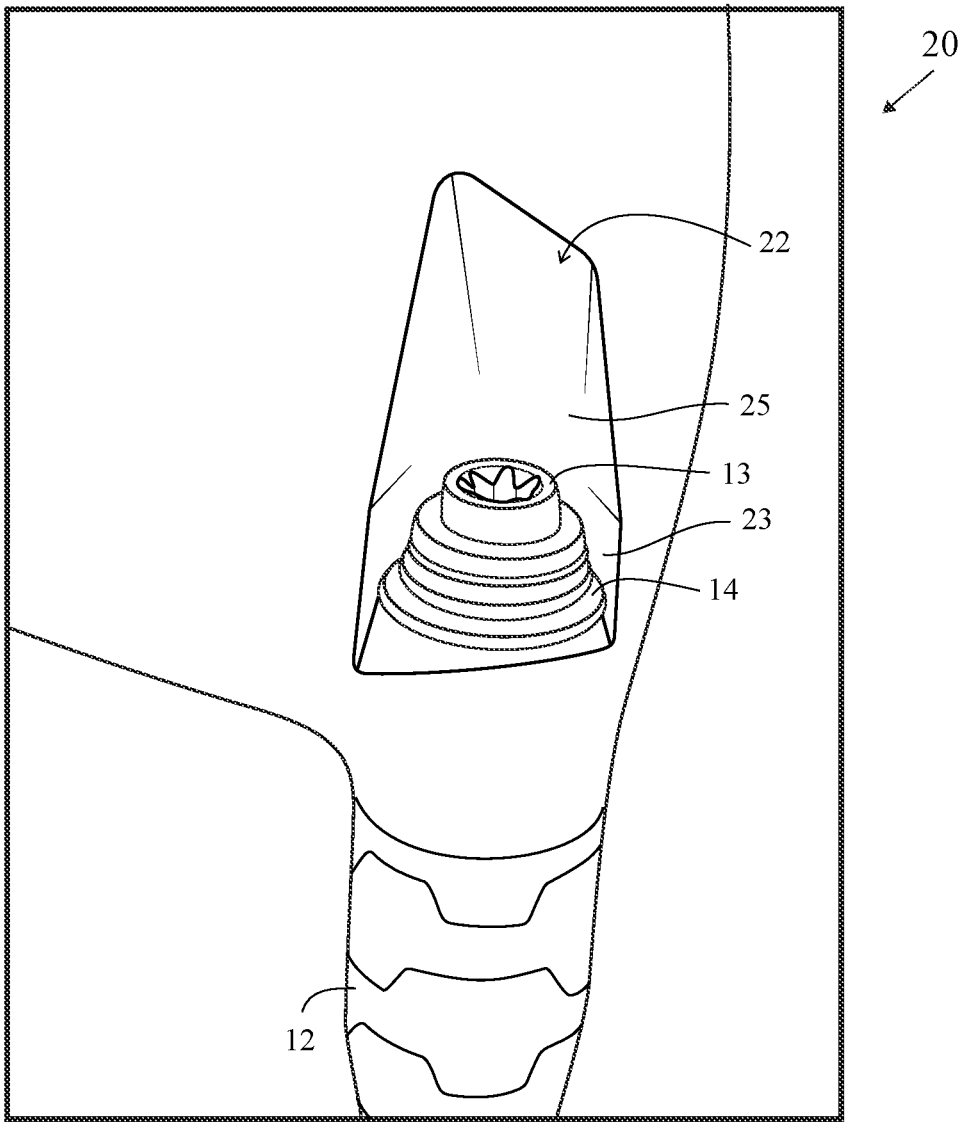
FIG. 11 is an isolated view of a preferred embodiment of the hosel exit bore of the present invention.
Figure 12:
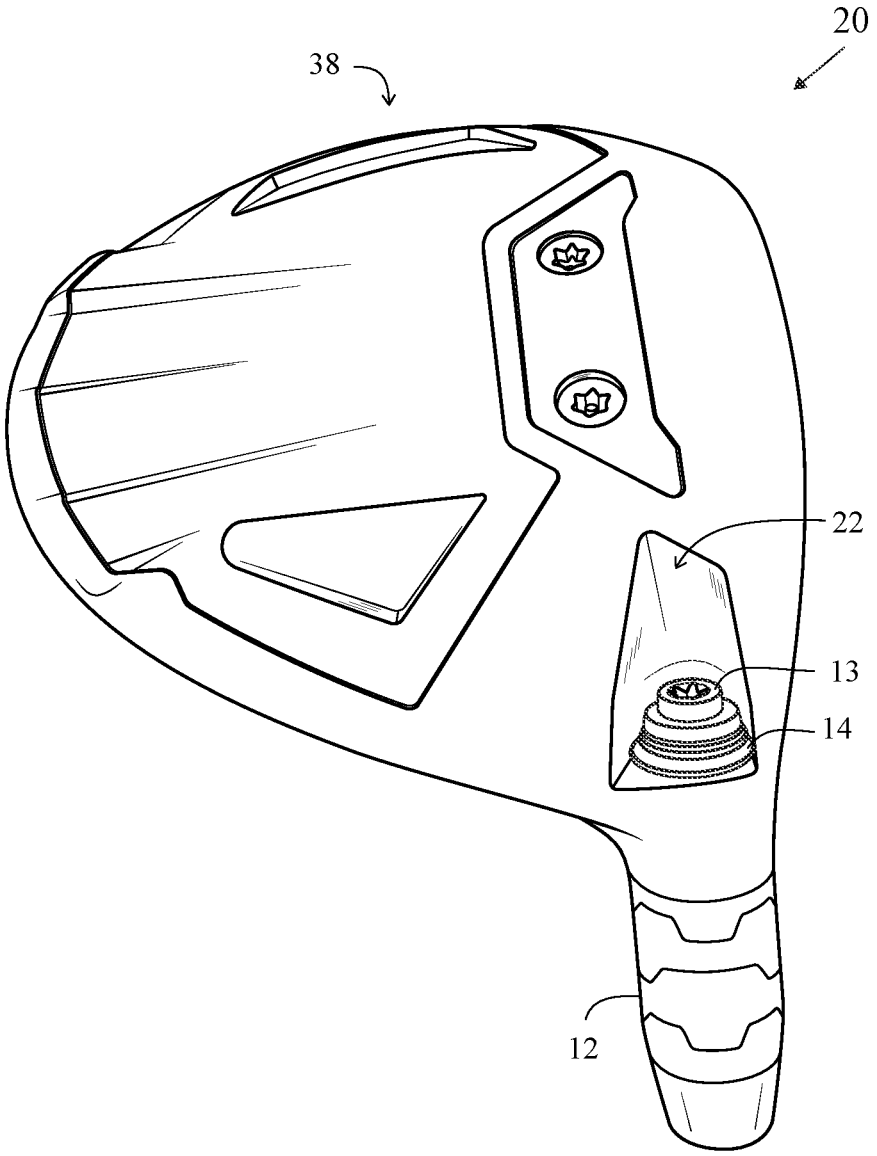
FIG. 12 is a bottom perspective view of a golf club head with a preferred embodiment of the hosel exit bore of the present invention.
Figure 13:
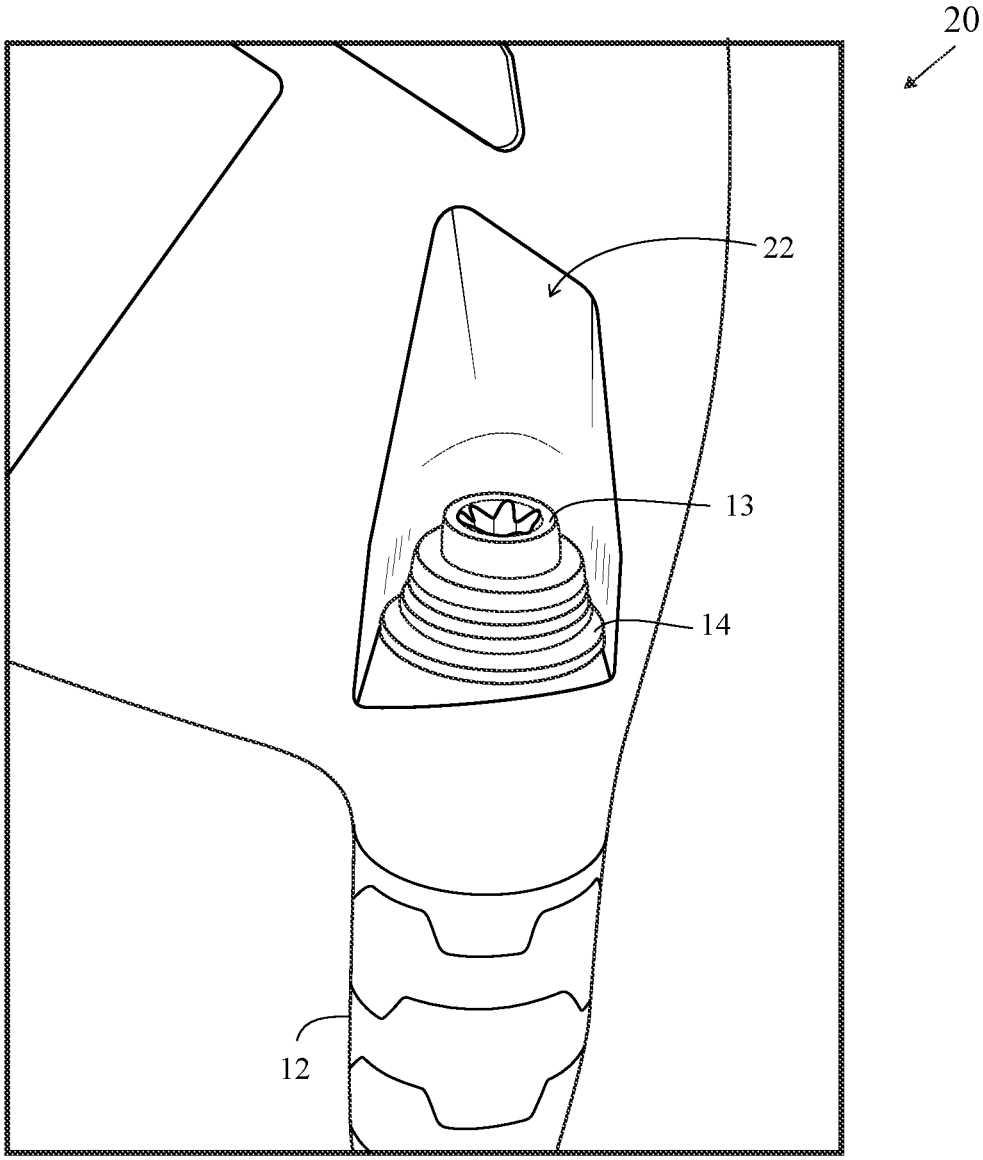
FIG. 13 is a heel side elevation view of a golf club head with a preferred embodiment of the hosel exit bore of the present invention.
Figure 14:
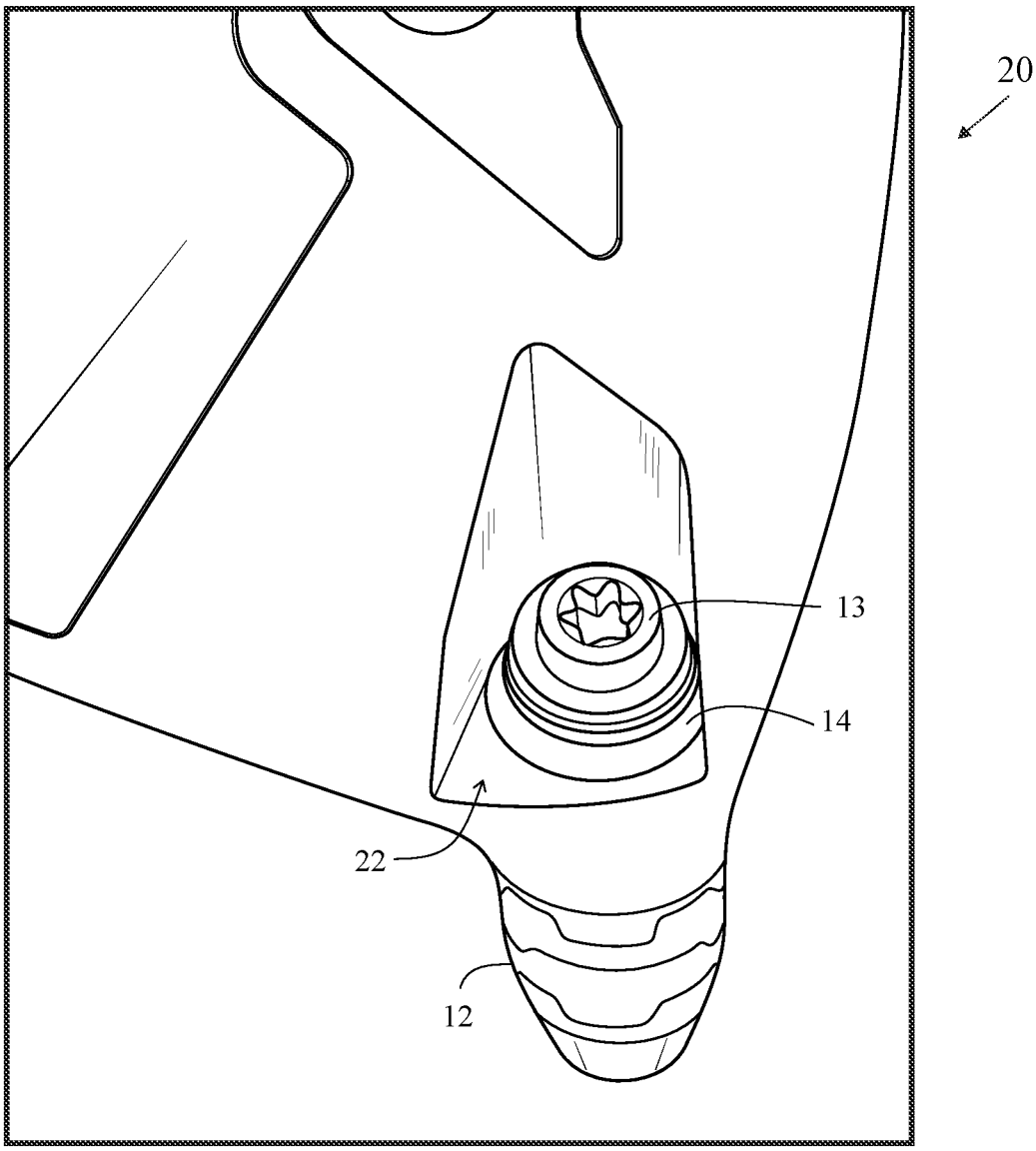
FIG. 14 is an isolated top plan view of a preferred embodiment of the hosel exit bore of the present invention.

The hosel exit bore 22 preferably has a volume less than 0.12 cubic inch and a length ranging from 0.5 inch to 1.0 inch. FIG. 8 shows the volume V1=0.128585 $in^3$ of a hosel exit bore 22' of a prior art golf club. FIGS. 9 and 10 show the volumes of a hosel exit bore 22 of the present invention, V2=0.100630 in$^3$, and V3=0.111557 in$^3$, respectively.

In another embodiment, the hosel exit bore 22 defines a volume less than 0.112 cubic inch, is less than 0.2 inch from the striking plate, and is less than 0.2 inch from the crown wall.

FIGS. 11 through 14 show a preferred embodiment of the hosel exit bore 22.

Preferably, the upper section 23 of the hosel exit bore 22 has a depth ranging from 0.25 inch to 0.5 inch. The lower section 25 of the hosel exit bore 22 has a depth ranging from 0.1 inch to 0.3 inch.

The hosel assembly is shown in an exploded view in FIG. 16. The golf club is shown in an exploded view in FIG. 17. The hosel assembly 12 includes a screw 13, at least one washer 14, adjustable rings 52, 54, a shaft sleeve 19 with a threaded tip end, and a ferrule 50.

The golf club 10 comprises a club head 20, a hosel assembly 12, a shaft 15, and a grip 18.

The golf club head 20 comprises a body with a heel side 24, a toe side 26, a sole wall 38, crown wall 36, a striking plate 32, and a hosel 44. The sole wall 38, the crown wall 36, and the striking plate 32 define a hollow interior cavity.

The body lacks a traditional, internal hosel tube construction. Instead of a hosel tube, the hosel has an opening that is in direct communication with the interior cavity, with a hosel axis extending through the center of the hosel opening. The body comprises an internal flange, which includes a flange opening, extending into the interior cavity from the heel side. The internal flange is located below the hosel opening, and extends at an angle $\alpha$ with respect to the hosel axis that is greater than 90°. Preferably, the internal flange is cantilevered, attached to the heel side of the body so that at least one edge of the flange is suspended within the interior cavity. Replacing a hosel tube with an internal flange minimizes the mass of the structure proximate the face, thereby improving the overall flexibility of the face.

The hosel opening is sized to receive a shaft sleeve 19, which is connected to the tip end 17 of a shaft 15, and which has a sleeve bore and a threaded tip end. The shaft sleeve 19 extends through a pair of adjustable rings 52, 54, and into the interior cavity via the hosel opening. The shaft sleeve 19 and rings 52, 54 may have any of the features disclosed in U.S. Pat. No. 9,174,097, the disclosure of which is hereby incorporated by reference in its entirety herein. Once the shaft sleeve 19 is disposed within the interior cavity, a retention screw having a head portion and a threaded extension portion is affixed to the shaft sleeve 19 by threading the extension portion through the flange opening and into the threaded tip end, forming an adjustable hosel assembly 12. This configuration effectively locks the shaft sleeve 19 to the internal flange of the body. In an alternative embodiment, instead of a retention screw, the shaft sleeve 19 may include a locking piece with a stem and ledge assembly as shown in U.S. Pat. No. 9,101,806, the disclosure of which is hereby incorporated by reference in its entirety herein.

The entire exit hole is drafted for pulling tool pieces. The washer and screw are not assembled together prior to placement in the hosel exit bore.

Myers, U.S. patent Ser. No. 11/090,531 for a Golf Club Head With Adjustable Hosel is hereby incorporated by reference in its entirety.

Myers et al., U.S. patent Ser. No. 10/716,980 for a Golf Club Head Having Stress Reducing Features is hereby incorporated by reference in its entirety.

Frederickson, U.S. patent Ser. No. 10/716,984 for a Golf Club Head With Adjustable Center Of Gravity is hereby incorporated by reference in its entirety.

Seluga et al., U.S. patent Ser. No. 10/532,258 for a Golf Club Head Having Stress Reducing Features is hereby incorporated by reference in its entirety.

Rice et al., U.S. patent Ser. No. 10/441,856 for a Golf Club Head is hereby incorporated by reference in its entirety.

DeMille et al., U.S. patent Ser. No. 10/406,407 for a Golf Club Head Elevated Internal Weight is hereby incorporated by reference in its entirety.

Myers et al., U.S. patent Ser. No. 10/369,435 for a Golf Club Head Having Stress Reducing Features is hereby incorporated by reference in its entirety.

Myers, U.S. patent Ser. No. 10/335,650 for a Golf Club Head With Adjustable Center Of Gravity is hereby incorporated by reference in its entirety.

Goudarzi et al., U.S. patent Ser. No. 10/213,663 for CG Height Adjustability By Conformal Weighting is hereby incorporated by reference in its entirety.

Foster et al., U.S. patent Ser. No. 10/172,110 for a Golf Club Head With Adjustable Center Of Gravity is hereby incorporated by reference in its entirety.

Rice et al., U.S. patent Ser. No. 10/213,664 for a Golf Club Head is hereby incorporated by reference in its entirety.

Seluga et al., U.S. patent Ser. No. 10/213,662 for a Golf Club Head Having Stiffening Members And Variable Face Thickness is hereby incorporated by reference in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention the following:

1. A golf club having a removable shaft, the golf club comprising:

a shaft having a butt end and a tip end;

a hosel assembly connected to the tip end of the shaft, the hosel assembly comprising a screw, at least one washer and a shaft sleeve having a threaded bore; and a golf club head having a sole wall, the sole wall having a hosel exit bore, the hosel exit bore having an upper section and a lower section, the upper section having a width greater than the lower section;

wherein the upper section is configured for transverse placement of a washer in the hosel exit bore;

wherein the screw threadingly engages the threaded bore through the at least one washer and the hosel exit bore;

wherein a width of the upper section ranges from 0.49 inch to 0.55 inch, and a width of the lower section ranges from 0.37 inch to 0.55 inch;

wherein a length of the upper section ranges from 0.15 inch to 0.25 inch;

wherein a first internal wall of the sole wall defines the upper section of the hosel exit bore and has an inward angle;

wherein a second internal wall of the sole wall defines the lower section of the hosel exit bore and forms an undercut portion below the first section of the sole wall;

wherein the second internal wall has an inward angle, the second internal wall is at an obtuse angle relative to the first internal wall and the second internal wall is at an acute angle to a third internal wall, and the third internal wall has a depth greater than a depth of the first internal wall.

2. The golf club according to claim 1 wherein the hosel exit bore defines a volume less than 0.12 cubic inch.

3. The golf club according to claim 1 wherein the hosel exit bore has a length ranging from 0.5 inch to 1.0 inch.

4. The golf club according to claim 1 wherein the upper section of the hosel exit bore has a depth ranging from 0.25 inch to 0.5 inch.

* * * * *